US008479545B2

(12) United States Patent
Teixeira

(10) Patent No.: US 8,479,545 B2
(45) **Date of Patent: *Jul. 9, 2013**

(54) KEY FOR USE WITH LOCK CORE HAVING SIDE PIN

(75) Inventor: Diana Teixeira, Brownsville, TX (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/306,378

(22) Filed: Nov. 29, 2011

(65) Prior Publication Data

US 2012/0240644 A1 Sep. 27, 2012

Related U.S. Application Data

(63) Continuation-in-part of application No. 12/729,925, filed on Mar. 23, 2010, now Pat. No. 8,065,897, which is a continuation-in-part of application No. 12/610,835, filed on Nov. 2, 2009, now Pat. No. 7,681,425, and a continuation-in-part of application No. PCT/US2007/067936, filed on May 1, 2007.

(51) Int. Cl.
*E05B 9/04* (2006.01)
*E05B 19/06* (2006.01)
*E05B 27/08* (2006.01)

(52) U.S. Cl.
USPC ..... 70/367; 70/371; 70/409; 70/419; 70/421; 70/491

(58) Field of Classification Search
USPC ..... 70/493–496, 491, 371, 405–407, 70/409, 419–421, 441, DIG. 49, 403, 404, 70/379 R, 379 A, 380
See application file for complete search history.

(56) References Cited

U.S. PATENT DOCUMENTS

| | | | | |
|---|---|---|---|---|
| 1,036,764 | A | 8/1912 | Wilson | |
| 1,173,677 | A * | 2/1916 | Muller | 70/493 |
| 1,375,521 | A | 4/1921 | Lasky | |
| 2,000,829 | A | 5/1935 | Falk | |
| 2,064,955 | A | 12/1936 | Singer et al. | |
| 2,215,162 | A | 9/1940 | Scott | |
| 2,391,834 | A * | 12/1945 | Johnstone | 70/491 |
| 2,690,070 | A * | 9/1954 | Spain | 70/421 |
| 2,982,121 | A * | 5/1961 | George | 70/491 |
| 3,078,706 | A | 2/1963 | Russell | |
| 3,267,707 | A | 8/1966 | Adams | |
| 3,320,782 | A | 5/1967 | Turman | |
| 3,425,248 | A | 2/1969 | Duval | |
| 3,492,843 | A * | 2/1970 | Slaybaugh et al. | 70/388 |
| 3,541,819 | A * | 11/1970 | Kerr | 70/491 |
| 3,597,948 | A | 8/1971 | Johnstone | |
| 3,670,540 | A | 6/1972 | Fernandez | |
| 4,114,411 | A * | 9/1978 | Schlage | 70/421 |
| 4,328,692 | A | 5/1982 | Dice et al. | |
| 5,088,306 | A | 2/1992 | Field | |
| 5,615,566 | A * | 4/1997 | Brandt | 70/419 |
| 6,477,875 | B2 * | 11/2002 | Field et al. | 70/491 |
| 6,526,791 | B2 | 3/2003 | Shvarts | |
| 6,718,807 | B2 | 4/2004 | Andersson | |
| 6,945,082 | B2 * | 9/2005 | Field et al. | 70/409 |
| 7,377,146 | B2 | 5/2008 | Field et al. | |
| 7,681,425 | B2 * | 3/2010 | Teixeira | 70/367 |
| 8,065,897 | B2 * | 11/2011 | Teixeira | 70/367 |

* cited by examiner

*Primary Examiner* — Lloyd Gall
(74) *Attorney, Agent, or Firm* — Faegre Baker Daniels LLP

(57) ABSTRACT

A key body and an associated lock core are disclosed. The disclosed lock core includes a core body, a core sleeve, a core plug, and a side pin assembly including a side pin, a region pin, and a spring.

10 Claims, 14 Drawing Sheets

KEY FOR USE WITH LOCK CORE HAVING SIDE PIN

RELATED APPLICATIONS

The present application is a continuation-in-part of U.S. patent application Ser. No. 12/729,925, now U.S. Pat. No. 8,065,897, entitled "Key and Core with Side Pin" to Teixeria, which is a continuation of U.S. patent application Ser. No. 12/610,835, now U.S. Pat. No. 7,681,425 entitled "Key and Core with Side Pin" to Teixeria, which is a continuation-in-part of PCT International Patent Application No. PCT/US2007/067936, entitled "Key and Core with Side Pin" to McKibben et al., the disclosures of which are expressly incorporated by reference herein.

BACKGROUND AND SUMMARY OF THE INVENTION

The present invention relates to locks. More particularly, the present invention relates to a key and a lock core for a lock.

According to the present disclosure, several embodiments of lock cores are provided to facilitate retracting or extending of a latch bolt and/or deadbolt of a mortise lock, releasing of the shank of a padlock, or unlocking, locking, releasing or other movement of various locks. Additional disclosure of such locks is provided in U.S. Patent Application Ser. No. 60/610,639, to Hickman et al., entitled Mortise Lock, U.S. Patent Application Ser. No. 60/635,839, to Strong et al., entitled Lock core, U.S. Pat. No. 4,424,693, to Best et al., entitled Key-Removable Lock Core, U.S. Pat. No. 4,836,001, to Foshee, entitled High Security Lock, and U.S. Pat. No. 6,668,606, to Russell et al., entitled Electronic Token Lock Core, the disclosures of which are incorporated by reference herein. The disclosure of previously filed U.S. Provisional Patent Application Ser. No. 60/718,519, entitled "Key and Core", filed Sep. 19, 2005, to Strong et al. and U.S. Provisional Patent Application Ser. No. 60/845,647, entitled "Key and Core", filed Sep. 19, 2006, to Strong et al. are also incorporated by reference herein in its entirety.

To unlock such a lock, a user inserts a key into a lock core. The lock core includes a set of pin tumblers (not shown) that verify the accesses rights of the inserted key. If the key includes the proper bitting, the pin tumblers of the lock core will properly align in the lock core to permit operation of the lock. Additional details of key bitting and pin tumblers is provided in U.S. Pat. Nos. 4,424,693; 4,836,001; 5,136,869; and 6,668,606, the disclosures of which are expressly incorporated by reference herein. According to the present disclosure, a secondary system is also provided to verify the access rights of the key.

According to one aspect of the present invention, a key body is provided for use with an associated lock core. The associated lock core includes a sleeve defining an interior region and a finger-receiving notch and a core plug positioned in the interior region of the sleeve to permit rotational movement of the core plug relative to the sleeve. The core plug defines a longitudinally extending keyway and a side pin assembly passage. The side pin assembly passage is positioned adjacent to the keyway. The associated lock core further includes a side pin assembly including a side pin and a region pin separate from the side pin and positioned longitudinally adjacent to the side pin. The side pin assembly is positioned in the side pin assembly passage to move in a longitudinal direction between a first position blocking movement of the core plug relative to the sleeve and a second position permitting movement of the core plug relative to the sleeve. At least a portion of the region pin is positioned in the keyway. The side pin includes a finger positioned substantially in the finger-receiving notch of the sleeve when the side pin assembly is in the first position and positioned substantially out of the finger-receiving notch when the side pin assembly is in the second position, a substantially cylindrical body portion, and an arm extending rearward from the body portion. The finger extends transversely from the arm of the side pin. The substantially cylindrical body portion of the side pin has a central axis and the arm of the side pin having a central axis that is parallel and offset from the central axis of the substantially cylindrical body portion of the side pin. The key body associated with the lock core includes a bow and a key shank coupled to the bow. The key shank include a profile corresponding to a profile of the keyway, a longitudinally extending groove that corresponds to an exterior profile of the region pin, and a shoulder positioned to contact the region pin upon insertion of the key shank into the keyway to push on the side pin to move the finger of the side pin substantially out of the finger-receiving notch of the sleeve.

According to another aspect of the present invention, a key body for use with an associated lock core is provided. The associated lock core includes a sleeve defining an interior region and a finger-receiving notch and a core plug positioned in the interior region of the sleeve to permit rotational movement of the core plug relative to the sleeve. The core plug defines a longitudinally extending keyway and a side pin assembly passage. The side pin assembly passage is positioned adjacent to the keyway. The associated lock core further includes a side pin assembly positioned in the side pin assembly passage to move in a longitudinal direction between a first position blocking movement of the core plug relative to the sleeve and a second position permitting movement of the core plug relative to the sleeve. At least a portion of side pin assembly is positioned in the keyway. The side pin assembly includes a finger positioned substantially in the finger-receiving notch of the sleeve when the side pin assembly is in the first position and positioned substantially beyond the finger-receiving notch when the side pin assembly is in the second position, a substantially cylindrical body portion, and an arm extending rearward from the body portion. The finger extends transversely from the arm of the side pin assembly. The substantially cylindrical body portion of the side pin assembly has a central axis and the arm of the side pin assembly has a central axis that is parallel and offset from the central axis of the substantially cylindrical body portion of the side pin assembly. The key body associated with the lock core includes a bow and a key shank coupled to the bow. The key shank includes a profile corresponding to a profile of the keyway of the associated lock core, a longitudinally extending groove that corresponds to an exterior profile of the side pin assembly of the associated lock core, and a shoulder positionable to contact the side pin assembly of the associated lock core upon insertion of the key shank into the keyway to push on the side pin assembly to move the finger of the side pin assembly beyond the finger-receiving notch of the sleeve.

BRIEF DESCRIPTION OF THE DRAWINGS

A detailed description particularly refers to the accompanying figures in which.

DETAILED DESCRIPTION OF THE DRAWINGS

Figure 10:
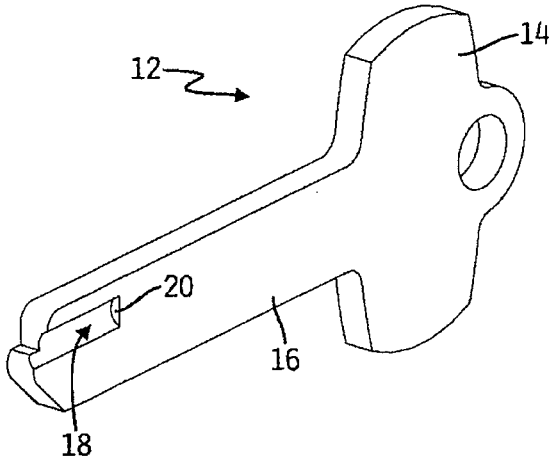
FIG. 10 is a perspective view of a key blank.
Figure 11:
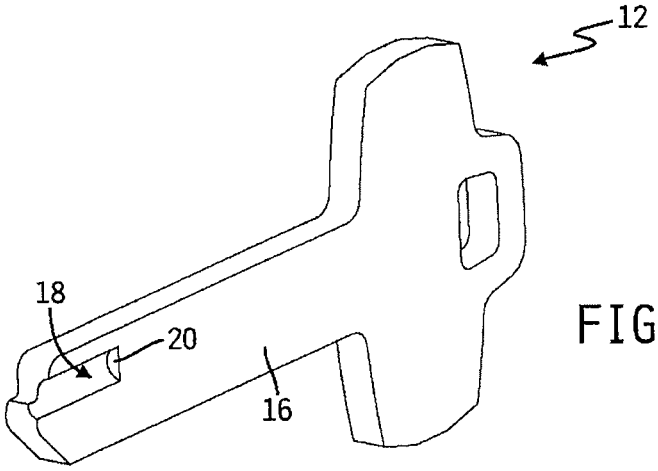
FIG. 11 is a perspective view of another key blank.
Figure 12:
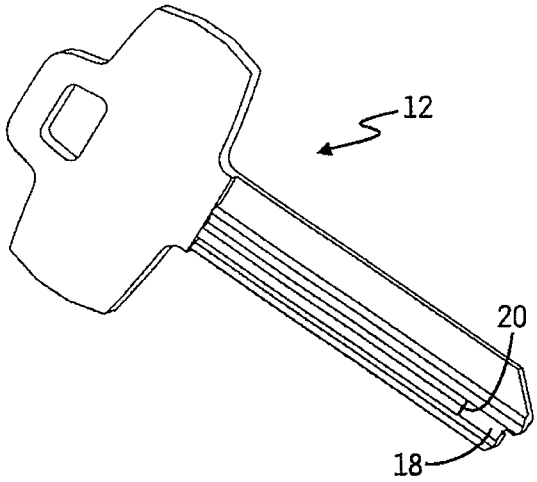
FIG. 12 is a perspective view of a slotted key blank.
Figure 13:
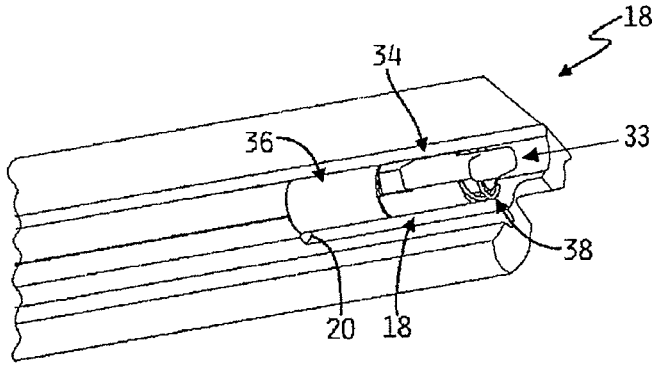
FIG. 13 is a perspective view of a key blank, core side pin, region pin, and spring.
Figure 14:
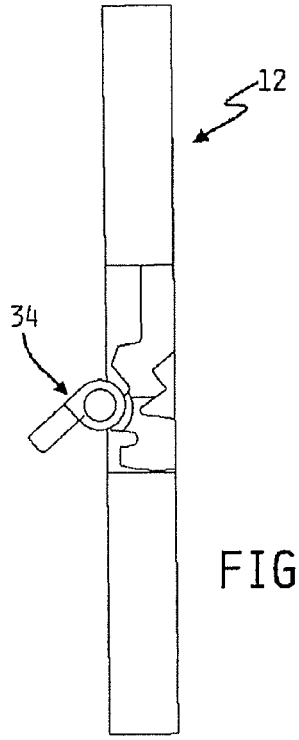
FIG. 14 is an end view showing the key blank and core side pin of FIG. 13.

According to the present disclosure, a lock core 10 is provided that include pin tumblers (not shown) and a secondary system that verifies the access rights of a key/key blank/key body 12 shown in FIGS. 10-12. Key blank 12 includes a bow 14, key shank 16, and a recess or groove 18 formed in shank 16. A shoulder 20 defines an end of groove 18. Shoulder 20 and groove 18 interact with lock core 10 to enable operation of the lock. If an appropriate width key without groove 18 is inserted into lock core 10, the secondary system will block the key and block operation of lock core 10.

Figure 1:
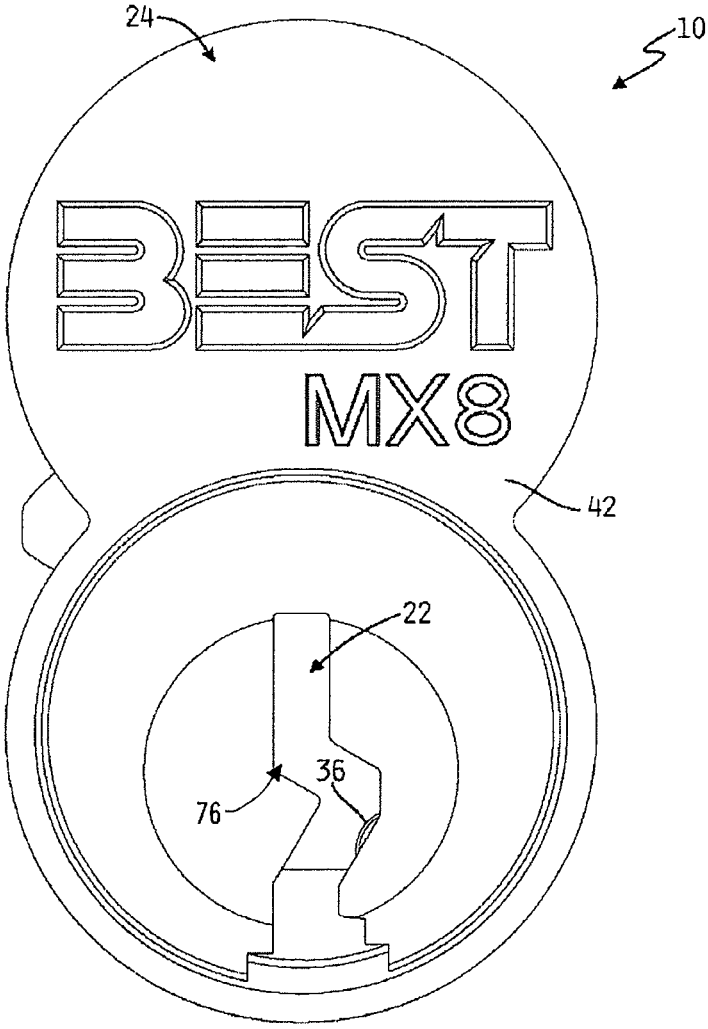
FIG. 1 is front view of a lock core showing the lock core including a face plate and a core plug positioned behind the face plate.

As shown in the FIG. 10, key/key blank 12 is a blank. Before use, it is understood that shank 16 is milled, ground, or otherwise machined to include bitting matching the pin tumbler arrangement of lock core 10. Shank 16 is provided with a profile including longitudinal grooves to match the profile of keyway 22 shown in FIG. 1. Key blank 12 may also be profiled to match the profile of other keyways, such as those shown in the previously referenced U.S. patents.

Figure 8:
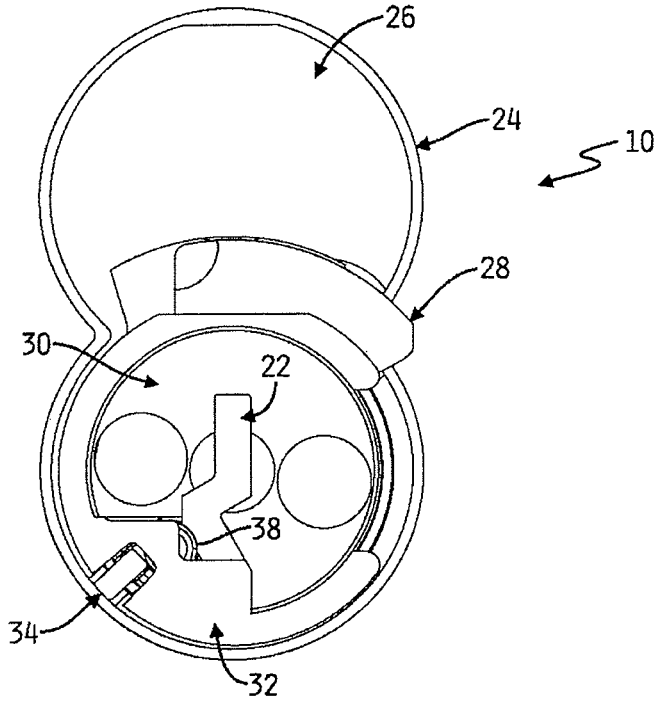
FIG. 8 is a rear view of the lock core.
Figure 9:
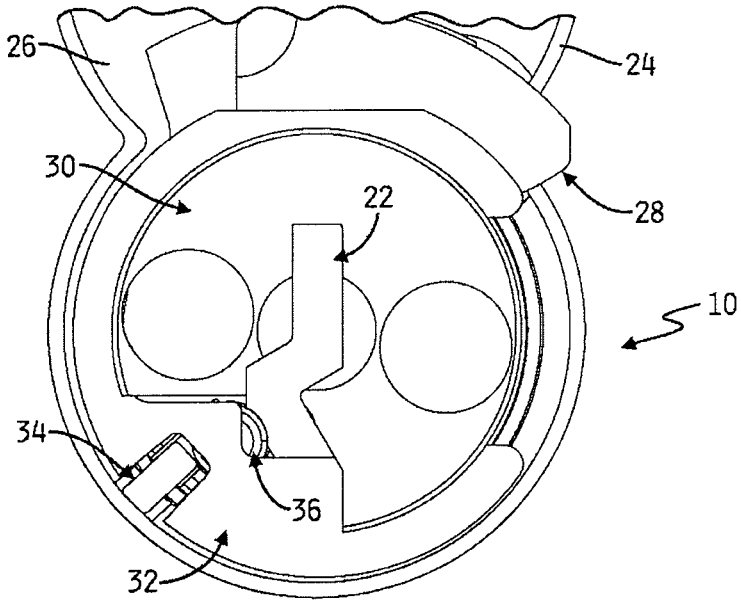
FIG. 9 is a view similar to FIG. 8.
Figure 26:
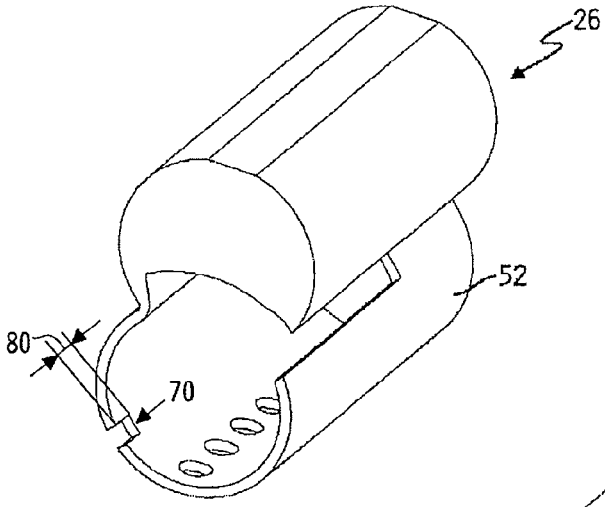
FIG. 26 is a perspective view of the core body.
Figure 27:
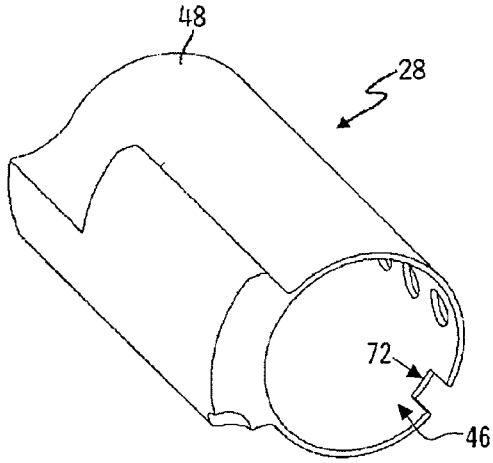
FIG. 27 is a perspective view of the core sleeve.
Figure 28:
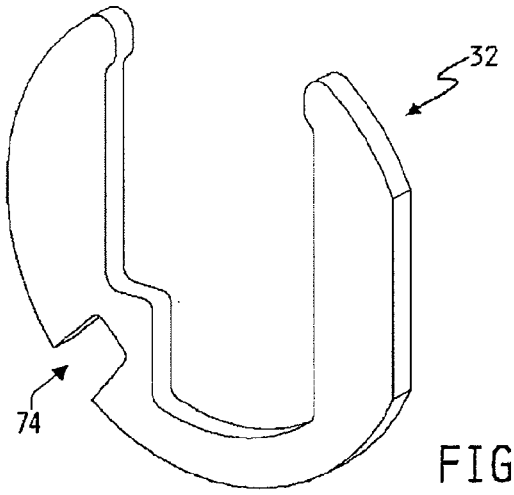
FIG. 28 is a perspective view of the core clip.

Lock core 10 includes a "figure-8" face plate 24, a "figure-8" core body 26 (shown in FIGS. 2 and 26), a core sleeve 28 (shown in FIGS. 3 and 27), core plug 30, and core clip 32. The secondary system includes a side pin assembly 33 including side pin 34, a substantially cylindrical region pin 36 separate from side pin 34, and a spring 38.

To assemble lock core 10, a rear end 40 of core plug 30 is inserted through a front 42 of face plate 24 until a shoulder 44 of core plug 30 seats against face plate 24. Face plate 24 may be provided with a counter bore on its front face to receive shoulder 44 of plug so that the face of face plate 24 and core plug 30 are flush. A front end 48 of core sleeve 28 is inserted over rear end 40 of core plug 30 until front end 48 abuts face plate 24 and core plug 30 is positioned in an interior region 46 of core sleeve 28. Front end 52 of core body 26 is then inserted over a rear end of core sleeve 28 until front end 48 abuts face plate 24. Core body 26 includes a stud (not shown) on front end 52 that is positioned within a corresponding recess 53 (shown in FIG. 3) on face plate 24 to block relative rotation between face plate 24 and core body 26.

As shown in FIGS. 20-25, the various embodiments of core plug 30 include a side pin assembly passage 56 that receives components of side pin assembly 33. Passage 56 includes a substantially cylindrical portion 58 that receives region pin 36 and a portion of side pin 34. Substantially cylindrical portion 58 overlaps with keyway 22 so that portions of side pin 34 and region pin 36 extend into keyway 22.

Figure 15:
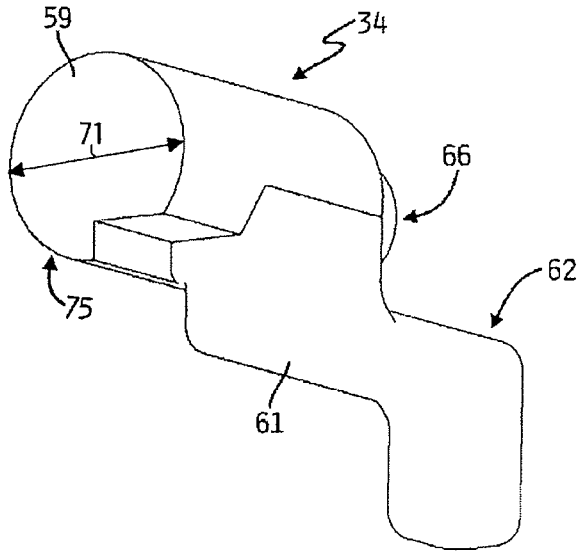
FIG. 15 is a perspective view of the core side pin.
Figure 16:
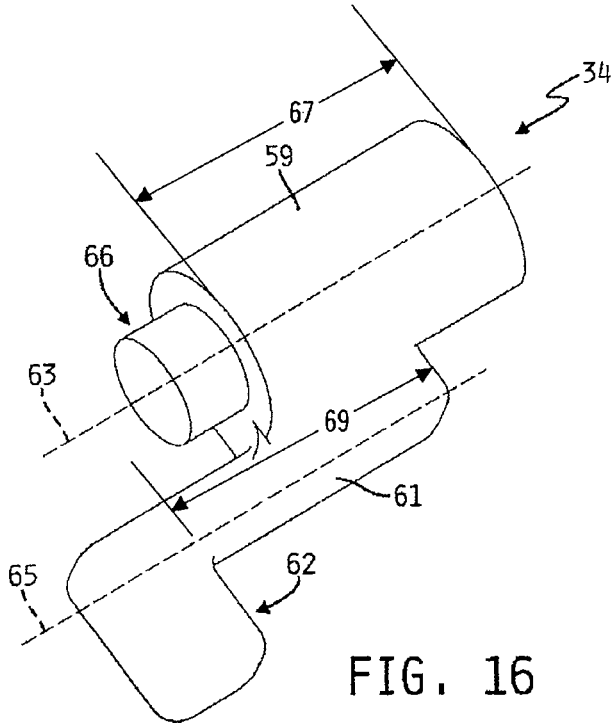
FIG. 16 is another perspective view of the core side pin of FIG. 15.
Figure 17:
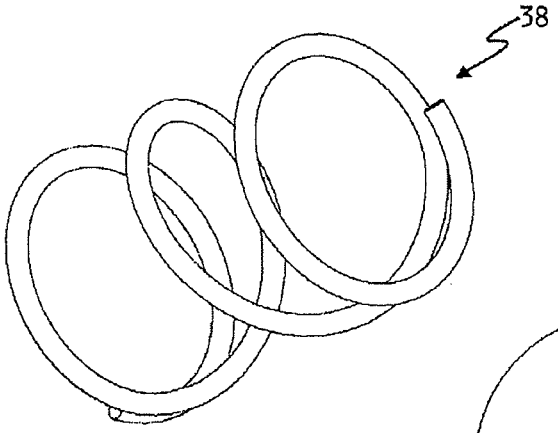
FIG. 17 is a perspective view of the spring that biases the core side pin toward the front of the lock core.
Figure 18:
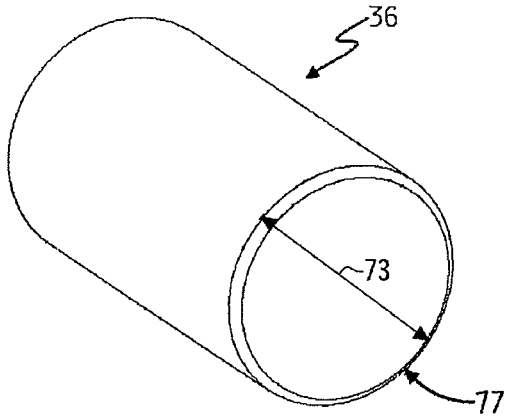
FIG. 18 is a perspective view of the region pin positioned within the core plug.
Figure 19:
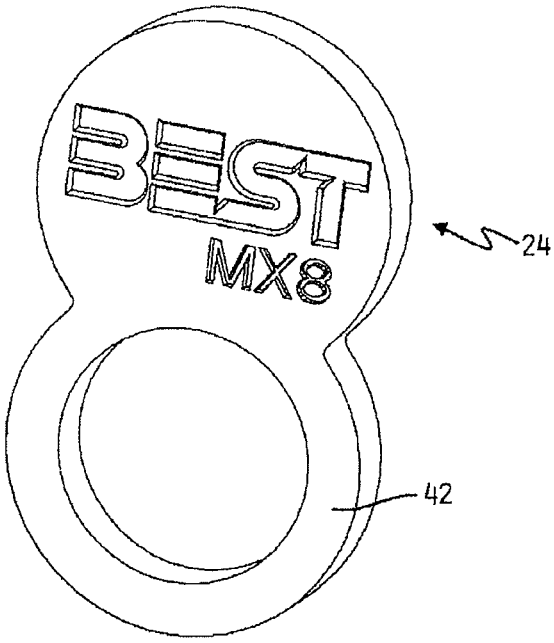
FIG. 19 is a perspective view of the face plate of the lock core.
Figure 20:
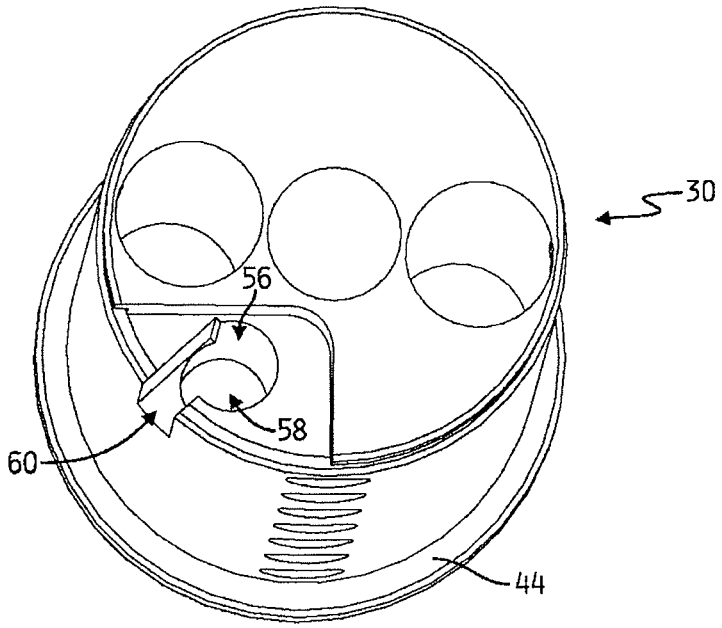
FIG. 20 is a perspective view of a core plug.
Figure 21:
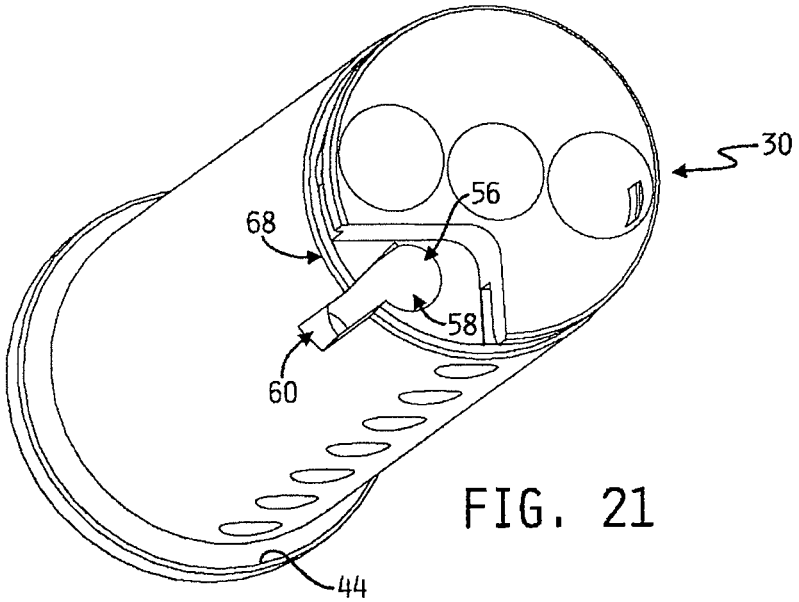
FIG. 21 is another perspective view of the core plug of FIG. 20.
Figure 22:
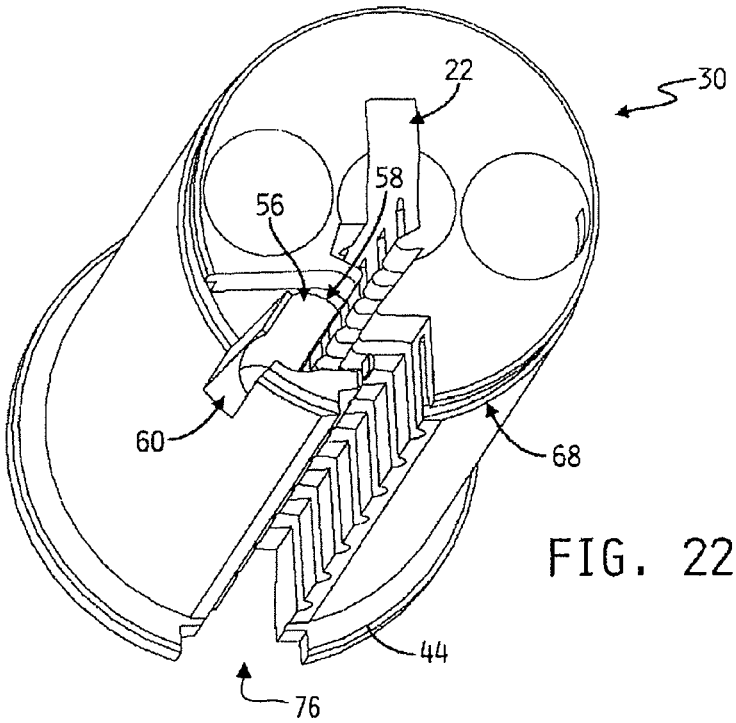
FIG. 22 is a perspective view of another core plug.
Figure 23:
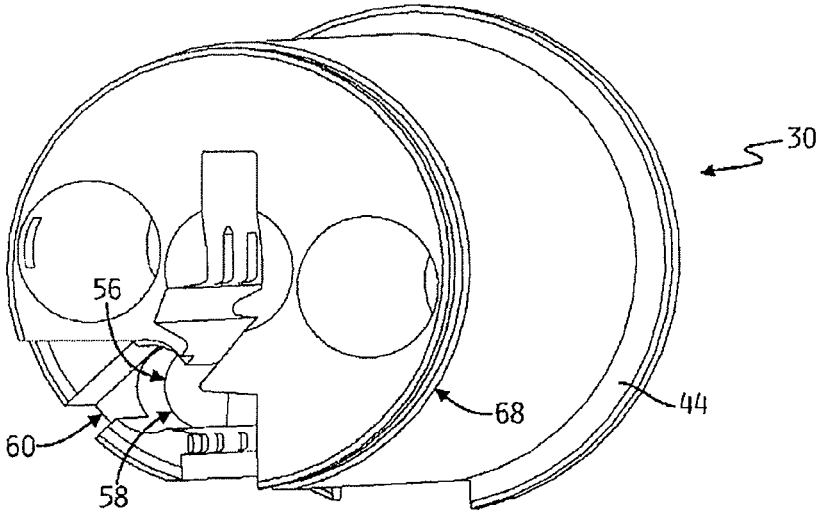
FIG. 23 is another perspective view the core plug of FIG. 22.
Figure 24:
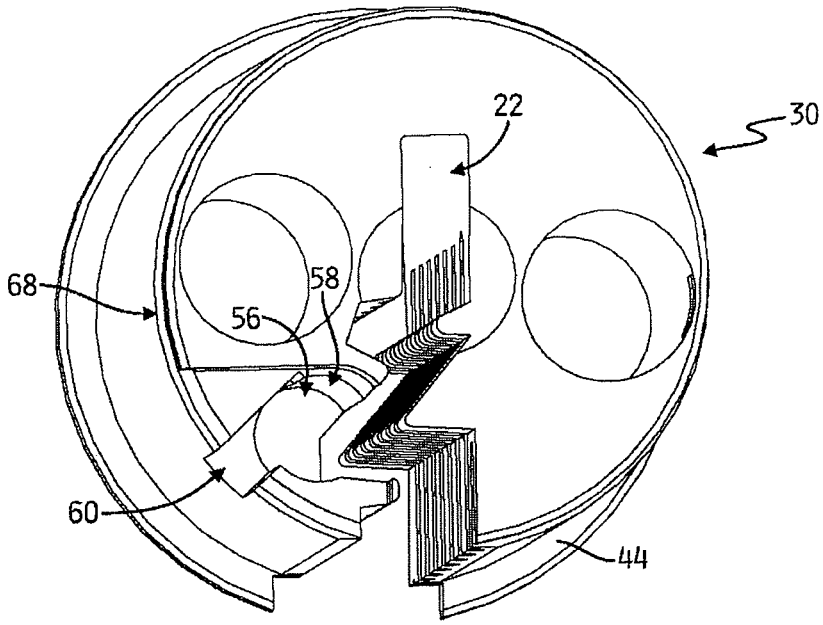
FIG. 24 is another perspective view of the core plug of FIG. 22.
Figure 25:
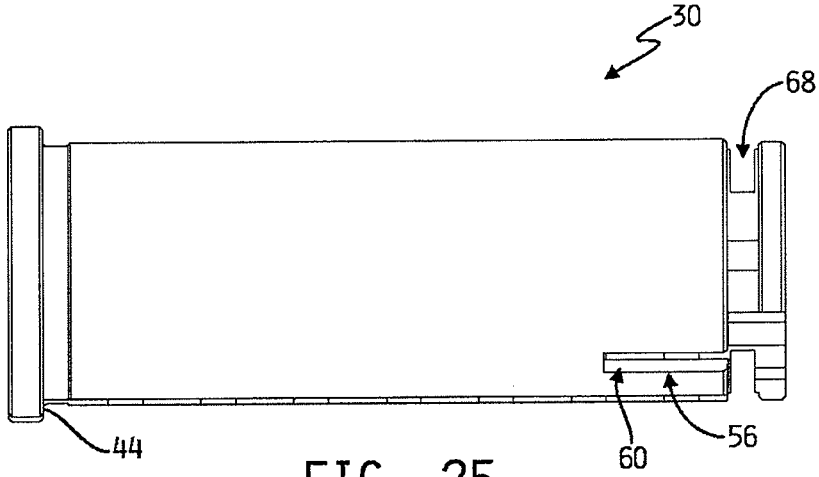
FIG. 25 is side elevation view of the core plug of FIG. 22.

Side pin 34 includes a cylindrical body portion 59, an arm 61, and a finger 62 as shown in FIGS. 15 and 16. Body portion 59 includes a central axis 63 and arm 61 includes a central axis 65 that is parallel and offset from central axis 63 of body portion 59. A length 67 of body portion 59 is substantially equal to a length 69 of arm 61. Body portion 59 is substantially cylindrical and has a diameter 71 that is equal or substantially equal to a diameter 73, shown in FIG. 18, of region pin 36. Body portion 59 includes a surface 75 that is parallel to and abuts a surface 77 of region pin 36 at least when key 12 is inserted into keyway 22, causing surface 77 of region pin 36 to push on surface 75 of body portion 59.

Figure 2:
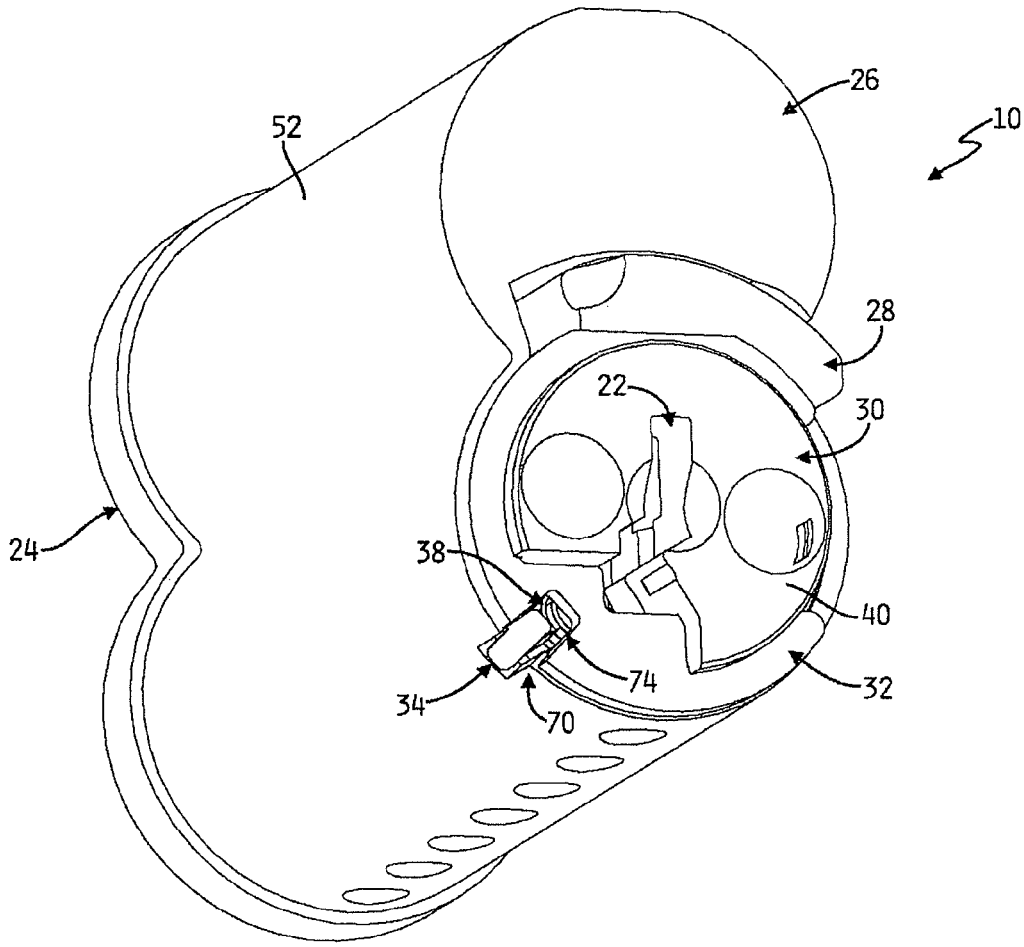
FIG. 2 is a rear perspective view of the lock core of FIG. 1 showing a core body positioned over the core plug and behind the face plate.
Figure 3:
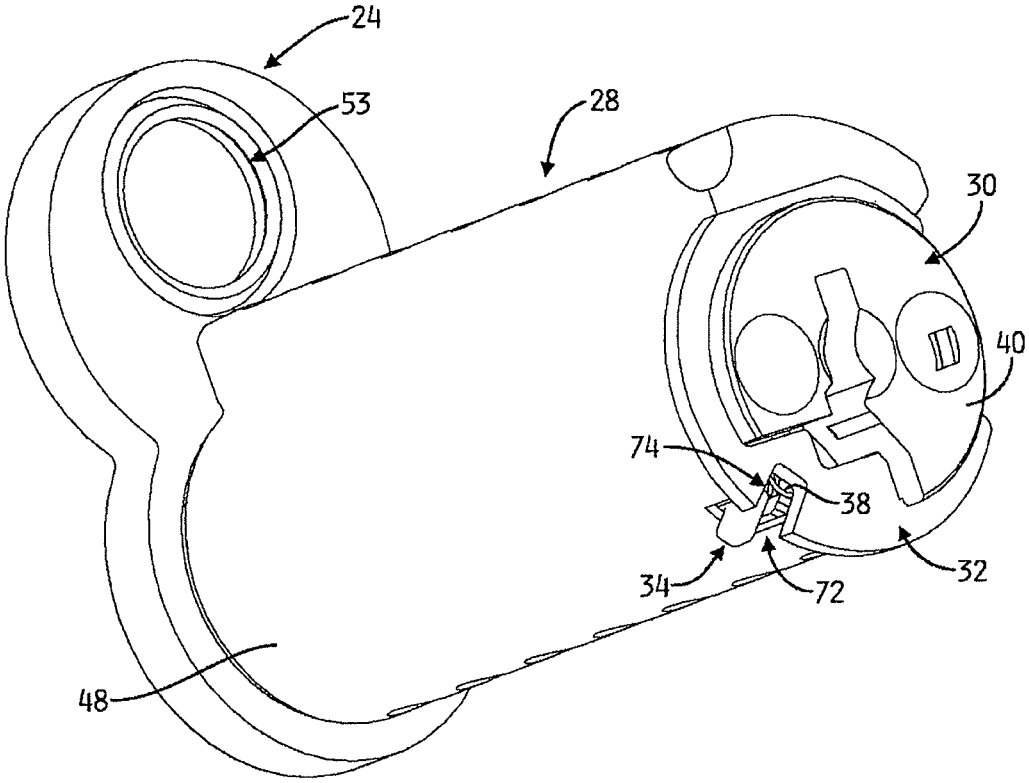
FIG. 3 is a view similar to FIG. 2 showing the core body removed from the lock core to expose a core sleeve that is normally positioned with the core body.
Figure 4:
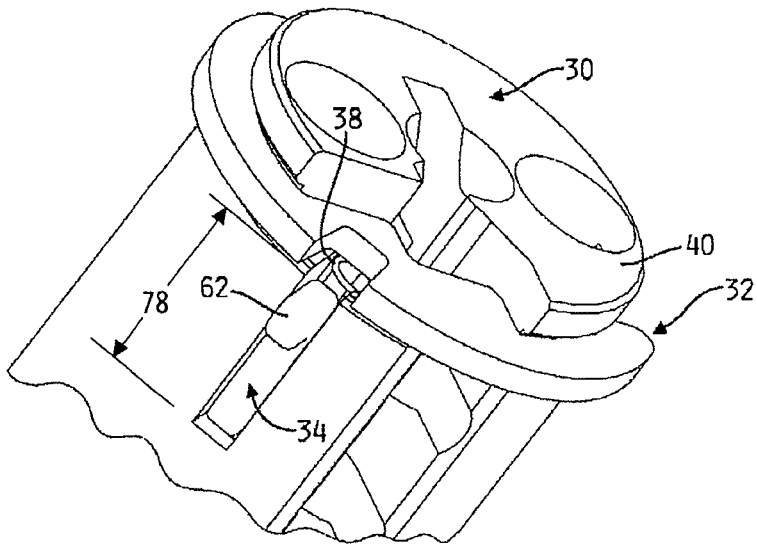
FIG. 4 is a perspective view of a back end of the lock core showing a core clip coupled to the core plug and a portion of a core side pin extending through a notch in the core plug.
Figure 5:
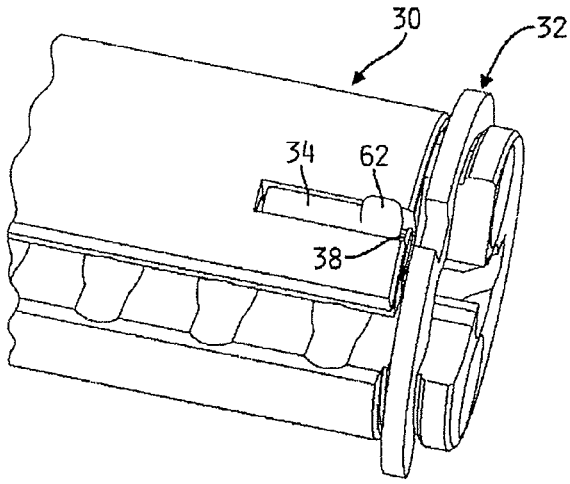
FIG. 5 is a perspective view similar to FIG. 4.
Figure 6:
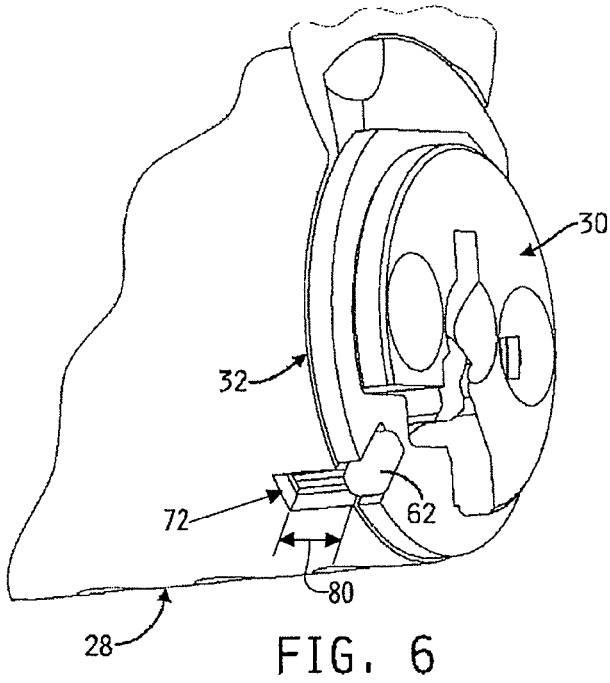
FIG. 6 is a perspective view of the back end of the lock core showing the core side pin moved to an unlocked position with a finger of the core side pin positioned in a notch of the core clip.
Figure 7:
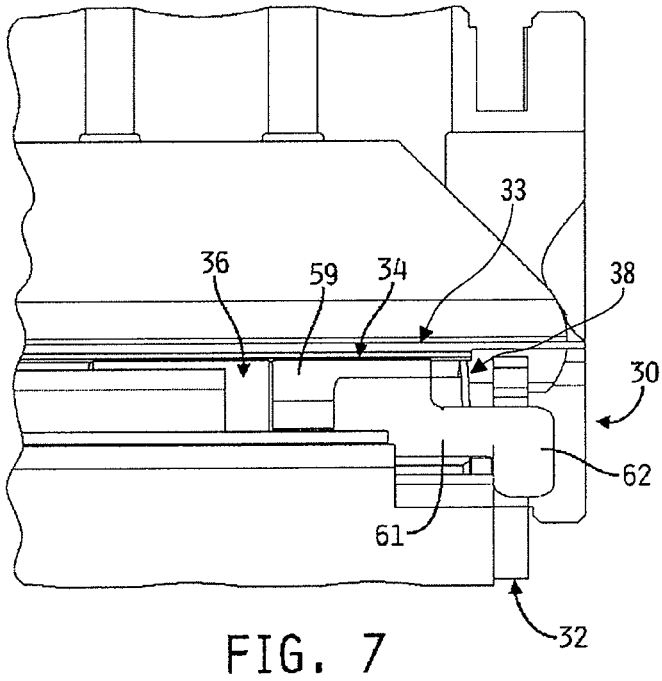
FIG. 7 is a side elevation view showing the finger of the core side pin positioned in the notch of the core clip.

Passage 56 also includes a notch 60 that receives a finger 62 of side pin 34. During assembly, region pin 36 is inserted into rear end 40 of core plug 30 into passage 56. After region pin 36 is positioned in core plug 30, side pin 34 is inserted into passage 56 so that finger 62 extends in a rearward direction and is positioned in notch 60 of passage 56. Spring 38 is positioned in passage 56 over a spring seat or post 66 of side pin 34. Core clip 32 is then positioned in an annular groove 68 in rear portion of core plug 30. Core clip 32 couples core plug 30 and core sleeve 28 to core body 26. Additionally, spring 38 urges side pin 34 away from core clip 32 toward an opening 76 in keyway 22. As shown in FIGS. 2 and 3, core body 26, core sleeve 28, and core clip 32 include respective finger-receiving notches 70, 72, 74 that align with notch 60 of passage 56 to receive finger 62 of side pin 34. Notch 60 of core plug 30 defines arm-receiving notch 60 in which arm 61 of side pin 34 is positioned as shown in FIG. 5. Arm-receiving notch 60 has a length 78 that is longer than a length 80 of finger-receiving notches 70, 72, of core body 26 and core sleeve 28.

To operate lock core 10, an authorized key blank 12 is inserted into opening 76 of keyway 22. Assuming authorized key blank 12 has the appropriate sized and positioned groove 18 and shoulder 20, key blank 12 can be fully inserted into keyway 22. Otherwise, region pin 36 and/or side pin 34 will interfere with key blank 12 and block full insertion of key blank 12 into keyway 22. If key blank 12 is not fully inserted, the bitting of key blank 12 will not align with the appropriate tumblers (not shown) and will not allow core plug 30 to rotate to unlock the lock. According to the illustrated embodiment, region pin 36 and side pin 34 have cylindrical profiles and groove 18 is also cylindrical. Shoulder 20 is circular. According to alternative embodiments, region and side pins 36, 34 may be square, triangular, or other shapes and groove 18 and shoulder 20 are likewise square, triangular, or other shapes that correspond to region an side pins 36, 34.

In addition to aligning the tumblers, authorized key blank 12 moves side pin 34 from a locked position to an unlocked position. When side pin 34 is in the locked position, finger 62 of side pin 34 extends through notches 70, 72 of core body 26 and core sleeve 28 and blocks rotation of core plug 30 relative to core body 26. When side pin 34 is in the unlocked position, finger 62 moves rearward into notch 74 of core clip 32 beyond the rear ends of core sleeve 28 and core body 26 and finger 62 no longer blocks rotation of core plug 30 relative to core sleeve 28 and core body 26.

During insertion of an authorized key blank 12 into keyway 22, shoulder 20 contacts region pin 36. As key blank 12 is further inserted, region pin 36 slides along passage 56 and contacts side pin 34 and urges side pin 34 against spring 38 until side pin 34 is in the unlocked position. Assuming key blank 12 has the proper bitting, it will move the tumblers to the proper position to allow rotation of core plug 30.

If a key similar to authorized key blank 12, but without groove 18, is inserted into keyway 22, region pin 36 and side pin 34 will interfere with full insertion of the key. Because such a key is not fully inserted, the bitting of such a key, even if correct, will not move the tumblers to the proper position to allow rotation of core plug 30.

On occasion, a key similar to authorized key blank 12 with correct bitting and groove 18, but with shoulder 20 in the incorrect position along the key, may be presented for use with lock core 10. If such a key with a shoulder 20 that is too close to bow 14 is inserted into lock core 10, it will not move region pin 36 and side pin 34. Thus, finger 62 will not move out of notches 70, 72. If such a key with a shoulder 20 too far from bow 14 is inserted into lock core 10, region pin 36 and side pin 34 will block full insertion of the key into lock core 10 so the bitting will not align with the appropriate tumblers.

The length and radius of region pin 36 can be varied to provide additional variations for matched lock cores and keys. Thus, for a key to work properly, cylindrical portion 58 of passage 56 should have the proper radius and depth to match the selected length and radius of region pin 36. Regardless of the length or radius of region pin 36, the same side pin 34 is used. According to one method of manufacture, cylindrical portion 58 of passage 56 has a standard length for region pins having different lengths. Thus, for a shorter region pin 36, cylindrical portion 58 will have extra empty space. For a longer region pin 36, cylindrical portion 58 will have less or no empty space. According to one embodiment, no region pin 36 is provided and the key directly contacts side pin 34.

During many sales of lock cores 10, one or more key blanks 12 are provided with lock cores 10. To operate a particular lock core 10, key blanks 12 should be milled to provide bitting that matches the particular tumbler configuration of the particular lock core 10. Key blank 12 may or may not already including the proper groove 18 or shoulder 20.

Authorized sales of these lock cores 10 and key blanks 12 are made by the owner of the claimed invention. At the time of drafting of the present document, the claimed invention is owned by Stanley Security Solutions, Inc. of Indianapolis, Ind. Ownership of the claimed invention may change and can be verified by checking the assignment records of the United States Patent & Trademark Office.

To provide for additional user of a particular lock core 10, additional key blanks 12 may be provided. Because there are many types of key blanks, it is necessary to associate a particular key blank with a particular type of lock core. One way to facilitate such an association is to match a key blank with a trademark of a particular lock core. Currently, the trademarks associated with lock core 10 are "CORMAX" and "MX8." One way to associate key blank 12 with lock core 10 is for a provider of key blanks 12 to indicate that key blank 12 is suitable for use with the "MX8" lock core 10. For example, a provider might state, "Key Model No. XXX is suitable for use with the MX8 lock core." Tables or other formats may also be used indicating the key blank model number and the associated lock core.

To facilitate the purchase of such key blanks, a provider may advertise the association by referencing the trademark, such as MX8, in promotional materials, catalogs, brochures, or through other advertising means known to those of ordinary skill in the arts. Often, a provider of key blanks 12 will advertise or promote their particular key blank 12 as suitable for or will operate lock core 10. In response to such advertisement, the purchaser will request key blanks 12. In response to the request, the provider will sell key blanks 12 to the purchaser with the understanding, intent, and/or knowledge that the purchaser will use the key blanks 12 with lock cores 10.

Some providers of key blanks 12 may be authorized, such as those under distributor agreements or license agreements of the owner of the claimed invention. Other providers may not be authorized, such as those not under a distributor agreement, license agreement, or otherwise not sanctioned by the owner of the claimed invention. Authorized and unauthorized providers of key blanks 12 for use with lock core 10 may include retailers, such as hardware stores, lock smiths, or upstream distributors that provide bulk quantities of key blanks 12 to retailers, lock smiths, or others.

Unless otherwise stated herein, the figures are proportional. Although the present invention has been described in detail with reference to preferred embodiments, variations and modifications exist within the scope and spirit of the present invention.

The invention claimed is:

1. A method of facilitating the use of a lock, including the step of providing a key body for use with an associated lock core including a sleeve defining an interior region and a finger-receiving notch, a core plug positioned in the interior region of the sleeve to permit rotational movement of the core plug relative to the sleeve, the core plug defining a longitudinally extending keyway and a side pin assembly passage, the side pin assembly passage being positioned adjacent to the keyway, and a side pin assembly including a side pin and a region pin separate from the side pin and positioned longitudinally adjacent to the side pin, the side pin assembly being positioned in the side pin assembly passage to move in a longitudinal direction between a first position blocking movement of the core plug relative to the sleeve and a second position permitting movement of the core plug relative to the sleeve, at least a portion of the region pin being positioned in the keyway, the side pin including a finger positioned substantially in the finger-receiving notch of the sleeve when the side pin assembly is in the first position and positioned substantially out of the finger-receiving notch when the side pin assembly is in the second position, a substantially cylindrical body portion, and an arm extending rearward from the body portion, the finger extending transversely from the arm of the side pin, the substantially cylindrical body portion of the side pin having a central axis and the arm of the side pin having a central axis that is parallel and offset from the central axis of the substantially cylindrical body portion of the side pin, the key body associated with the lock core including a bow and a key shank coupled to the bow, the key shank including a profile corresponding to a profile of the keyway, a longitudinally extending groove that corresponds to an exterior profile of the region pin, and a shoulder positioned to contact the region pin upon insertion of the key shank into the keyway to push on the side pin to move the finger of the side pin substantially out of the finger-receiving notch of the sleeve.

2. The method of claim 1, wherein the groove is at least partially cylindrical.

3. The method of claim 2, wherein the shoulder is at least partially circular.

4. The method of claim 3, wherein the groove has a longitudinal length that is greater than a longitudinal length of the region pin of the associated lock core.

5. The method of claim 4, wherein the longitudinal length of the groove is substantially the same as a combined longitudinal length of the region pin and side pin of the associated lock core.

6. A method of unlocking a lock, the method including the steps of receiving a key body, and using the key body with an associated lock core including a sleeve defining an interior region and a finger-receiving notch, a core plug positioned in the interior region of the sleeve to permit rotational movement of the core plug relative to the sleeve, the core plug defining a longitudinally extending keyway and a side pin assembly passage, the side pin assembly passage being positioned adjacent to the keyway, and a side pin assembly positioned in the side pin assembly passage to move in a longitudinal direction between a first position blocking movement of the core plug relative to the sleeve and a second position permitting movement of the core plug relative to the sleeve, at least a portion of the side pin assembly being positioned in the keyway, the side pin assembly including a finger positioned substantially in the finger-receiving notch of the sleeve when the side pin assembly is in the first position and positioned substantially beyond the finger-receiving notch when the side pin assembly is in the second position, a substantially cylindrical body portion, and an arm extending rearward from the body portion, the finger extending transversely from the arm of the side pin assembly, the substantially cylindrical body portion of the side pin assembly having a central axis and the arm of the side pin assembly having a central axis that is parallel and offset from the central axis of the substantially cylindrical body portion of the side pin assembly, the key body associated with the lock core including a bow and a key shank coupled to the bow, the key shank including a profile corresponding to a profile of the keyway of the associated lock core, a longitudinally extending groove that corresponds to an exterior profile of the side pin assembly of the associated lock core, and a shoulder positionable to contact the side pin assembly of the associated lock core upon insertion of the key shank into the keyway to push on the side pin assembly to move the finger of the side pin assembly beyond the finger-receiving notch of the sleeve.

7. The method of claim 6, wherein the groove is at least partially cylindrical.

8. The method of claim 7, wherein the shoulder is at least partially circular.

9. The method of claim 8, wherein the side pin assembly of the associated lock core includes a side pin and a region pin separate from the side pin and positioned longitudinally adjacent to the side pin and the groove has a longitudinal length that is greater than a longitudinal length of the region pin of the associated lock core.

10. The method of claim 9, wherein the longitudinal length of the groove is substantially the same as a combined longitudinal length of the region pin and side pin of the associated lock core.

* * * * *